United States Patent [19]

Buchner et al.

[11] Patent Number: 4,735,336

[45] Date of Patent: Apr. 5, 1988

[54] OPENER FOR A PACKAGING CONTAINER

[75] Inventors: Norbert Buchner, Winnenden; Dieter Liede, Moglingen; Manfred Reichert, Remshalden-Buoch, all of Fed. Rep. of Germany

[73] Assignee: Robert Bosch GmbH, Stuttgart, Fed. Rep. of Germany

[21] Appl. No.: 40,670

[22] Filed: Apr. 21, 1987

[30] Foreign Application Priority Data

Jul. 7, 1986 [DE] Fed. Rep. of Germany ..... 3622795

[51] Int. Cl.[4] ..... B65D 17/34

[52] U.S. Cl. ..... 220/270

[58] Field of Search ..... 220/260, 267, 270, 359

[56] References Cited

U.S. PATENT DOCUMENTS

| | | | |
|---|---|---|---|
| 3,833,144 | 9/1974 | Bollmann et al. | 220/270 |
| 4,267,937 | 5/1981 | Piltz et al. | 220/270 |
| 4,399,924 | 8/1983 | Nilsson | 220/270 |
| 4,513,876 | 4/1985 | Buchner | 220/270 |
| 4,533,063 | 8/1985 | Buchner et al. | 220/270 |

*Primary Examiner*—George T. Hall

*Attorney, Agent, or Firm*—Edwin E. Greigg

[57] ABSTRACT

An improved opener for a packaging container arranged to form an opening in one wall to remove the contents includes a tear-open portion surrounded by a weakening line and a pull tab connected to the tear-open portion. To enable use of the pull tab as a reclosure element, it has a stopper-like lower extension which has a complemental outline to that of the tear-open portion and on which a shear edge is disposed. The pull tab is firmly connected to the tear-open portion with a narrow strip of a fusing glue.

11 Claims, 1 Drawing Sheet

OPENER FOR A PACKAGING CONTAINER

BACKGROUND OF THE INVENTION

The invention is directed to improvements in openers for packaging containers. In an opener of this kind, such as that disclosed in FIG. 5 of F.R.G. Offenlegungsschrift No. 32 35 167, the pull tab comprises a rigid double lever, which is joined to the tear-open portion in the cap of the packaging container by means of a weld seam in the vicinity of part of the weakening line. The pull tab is divided by the weld seam, which serves as a pivot axis for the pull tab, into a short arm having a shear edge near the weakening line and a long arm serving as the pull, and is used solely for removing the tear-open portion from the cap. It is not possible to reclose the container once the tear-open portion has been removed.

In addition, in F.R.G. Offenlegungsschrift No. 26 55 632, a container is disclosed having an opener in which a closure strip covers a preformed pour opening in the container cap. Using an extension engaging the pour opening the closure strip is glued over the entire surface area to the free portion of a covering foil secured to the inside of the container cap. To prevent removing the closure strip completely when opening the container, the end portion of the closure strip is also glued to the outside of the cap, outside the pour opening. Because of the slight rigidity of the closure strip, the closure strip does not lend itself to reclosure readily once the container has been opened.

OBJECT AND SUMMARY OF THE INVENTION

A principal object of the opener according to the invention is to provide the advantage over the prior art that after the first time the container is opened the pull tab, equipped with a closure stopper, can be inserted as a reclosure means into the pour opening created when the container is torn open and thus provides a tight closure.

A further object of the invention is to provide a durable enough closure that renders even repeated opening of the container readily possible with the rigid, easily grasped pull tab.

Still another object of the invention is to provide a pull portion disposed inside the hollow extension so that the pull tab does not protrude beyond the container wall, which feature is especially desireable in the event that the container has a pouring or emptying opening of relatively large size, or a full-surface opening where the entire top of the cap is torn open around the container wall.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
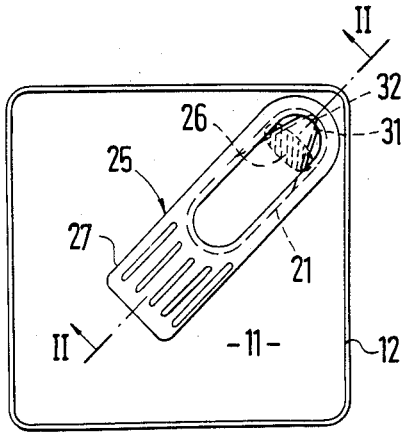
FIG. 1 is a plan view of a cap of a packaging container having an opener.

A packaging container having a body 10 of a multilayer packaging material is closed at its upper opening with a cap 11, which has an easily manipulated opener so that the contents of the container can be removed. The outlines of the body 10 and the cap 11 are square, with rounded corners. The cap 11 has a U-shaped peripheral fold 12, which wraps around the opening edge of the body 10 and is sealed or welded to it. The fold is formed by deep drawing or stretch forming of a multilayer composite material, which has an outer layer 14 of plastic, a middle layer 15 of metal, preferably aluminum, and an inner layer 16 of a heat-sealable plastic, as described for instance in F.R.G. Offenlegungsschrift No. 32 35 167. The outer layer 14 may also comprise some other rigid material than plastic, such as cardboard.

The opener in the cap 11 has a separable tear-open portion 20, which is surrounded by a weakening line 21 formed by hot or cold stamping or by scoring. The tear-open portion 20 may take various forms, such as an oval surface (as shown in FIG. 1), a teardrop shape, or a tear-open surface that covers the entire container cap. The weakening line 21 preferably pierces the outer support layer 14 either completely or in part, in the form of a notch; however, it may also engage the next layer, the sealing layer 15.

To remove the tear-open portion 20 and to uncover a pouring or emptying opening, the opener has a rigid pull tab, which is connected to the top of the tear-open portion 20 in the form of a spot or of a narrow strip 26 extending crosswise to the longitudinal direction of the pull tab 25. The connection preferably comprises a tough fusing glue of the kind available in commerce, which takes for a flexible connection between the tear-open portion 20 and a pull tab 25. The pull tab 25, which is injection molded or thermoformed from a thermoplastic plastic, is elongated and at one end has a flat, easily grasped pull portion 27 and adjoining it an extension 28 protruding downward from the plane of the pull portion 27. This extension 28 has a size and shape which substantially coincides in outline with the tear-open portion 20 defined by the weakening line 21 so that it may act as a stopper. The side wall of the extension 28 is preferably conically shaped. In the plane of the pull portion 27, a circumferential flange 30 surrounds the extension 28, which has a molded-in recess 29 open at the top. On the end of the pull tab 25 opposite the pull portion 27, the lower portion of the extension 28 is embodied as a point 31, which has a shear edge 32 disposed near the weakening line 21. The securing strip 26 of fusing glue is spaced apart by a short distance from this shear edge 32, so that the pull tab 25 is divided into a short lever arm having the shear edge 32 and a long lever arm having the pull portion 27.

To open the container by removing the tear-open portion 20, the pull tab 25 is grasped at the pull portion 27 and pulled upward; the pull tab 25 pivots about the securing strip 26 acting as a pivot axis and so the shear edge 32, by exerting pressure on an adjacent portion of the weakening line 21, breaks the pressed-down portion of the weakening line. After the line has begun to break, the pull tab 25 is pulled away from the point of breakage, and the tear-open portion 20 is gradually torn out by breakage of the weakening line 21. After some of the contents of the container have been removed, the uncovered pour opening can be closed, for reclosure of the container, by inserting the stopper-like extension 28 of the pull tab 25 into the pour opening. The conical shaping of the extension 28 of the pull tab 25 accommodates tolerances in the width of the pour opening, thereby assuring tight reclosure.

Figure 2:
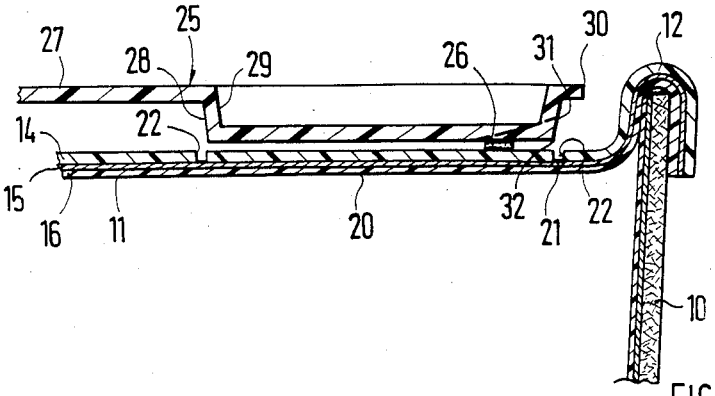
FIG. 2 is a cross-sectional view of part of a container having a cap as in FIG. 1, taken in the plane II—II of FIG. 1 and on a larger scale.
Figure 3:
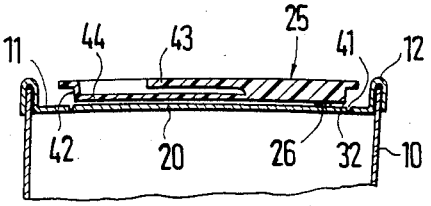
FIG. 3 shows a second exemplary embodiment of a container having an opener, seen in cross-section.

In the exemplary embodiment of FIG. 3, in which identical elements to those in the exemplary embodiment of FIGS. 1 and 2 described above are provided with the same reference numerals, the cap 11 has a nearly full-surface opening, which is determined by the weakening line 41 extending close to the peripheral fold 12. The extension 42 of the tear-open tab 25 is suitably matched to the width of the opening. In this exemplary embodiment, because the pull tab extends over nearly the entire surface of the cap 11, the pull portion 43 of the pull tab 25 is disposed in a recess 44. Opening and reclosing are done in the same way as in the first exemplary embodiment. While great rigidity of the pull tab 25 is advantageous in the embodiment of FIGS. 1 and 2 described above, in the exemplary embodiment of FIG. 3 a certain flexibility of the pull tab, which embodies the cap, is favorable.

It should also be noted that for favorable embodiment of the pivot axis of the pull tab 25 in the vicinity of the securing strip 26, a bead that promotes the pivoting may advantageously be provided in the cap. In that case, instead of the glued connection, a welded connection can also be provided, by transmitting heat to the outer thermoplastic layer of the cap 11 and to the bottom of the extension 28 of the pull tab 25. The extension 28, 42 acting as a stopper may also have an undercut on the wide wall, instead of a conical shape held in the opening by frictional engagement. Finally, reinforcing rips can also be provided to lend the pull tab a greater rigidity.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An opener for a packaging container having a body element and wall thereof a tear-open portion defined by a weakening line and a rigid pull tab secured adjacent a pivot axis, said pull tab being embodied as a double lever having a shear edge and a pull portion, the improvement comprising the pull tab is provided with a wall portion in which a laterally offset extension having an outline substantially complemental to that of the tear-open portion is defined, said estension adapted to serve as a stopper means for said tear-open portion, and the shear edge is disposed on the extension.

2. An opener as defined by claim 1, further wherein the extension has a conical shape.

3. An opener as defined by claim 1, further wherein an opposite side of the wall of the pull tab in which the extension is defined has a complementally-shaped hollow recess.

4. An opener as defined by claim 2, further wherein an opposite side of the wall of the pull tab in which the extension is defined has a complementally-shaped hollow recess.

5. An opener as defined by claim 1, further wherein the pull tab pull portion defines a plane and a circumferential flange surrounds the extension in that plane.

6. An opener as defined by claim 2, further wherein the pull tab pull portion defines a plane and a circumferential flange surrounds the extension in that plane.

7. An opener as defined by claim 3, further wherein the pull tab pull portion defines a plane and a circumferential flange surrounds the extension in that plane.

8. An opener as defined by claim 3, further wherein the pull portion is disposed in the hollow recess lying opposite the extension.

9. An opener as defined by claim 5, further wherein the pull portion is disposed in the hollow recess lying opposite the extension.

10. An opener as defined by claim 1, further wherein a connection provided between the extension and the tear-open portion is flexible.

11. An opening as defined by claim 10, further wherein the connection between the extension and the tear-open portion comprises a tough fusing glue.

* * * * *